US009847606B2

(12) United States Patent
Xie et al.

(10) Patent No.: US 9,847,606 B2
(45) Date of Patent: Dec. 19, 2017

(54) ELECTRICAL CONNECTOR HAVING EXTENDED SEPARATING WALL PORTION FOR PREVENTING INSERTION OF UNCUT TERMINALS

(71) Applicant: FOXCONN INTERCONNECT TECHNOLOGY LIMITED, Grand Cayman (KY)

(72) Inventors: Cen Xie, Kunshan (CN); Ming-Qi Ge, Kunshan (CN); Xian-Dong Bao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/462,936

(22) Filed: Mar. 20, 2017

(65) Prior Publication Data

US 2017/0271821 A1 Sep. 21, 2017

(30) Foreign Application Priority Data

Mar. 18, 2016 (CN) ..... 2016 1 0155325

(51) Int. Cl.

| | |
|---|---|
| ***H01R 13/648*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC ..... H01R 13/6587; H01R 13/6594; H01R 23/6873; H01R 23/7073

USPC ..... 439/660, 607.4, 924.1

See application file for complete search history.

(56) References Cited

U.S. PATENT DOCUMENTS

| | | | | |
|---|---|---|---|---|
| 8,635,097 | B2 * | 1/2014 | Uchida | G06Q 10/109 705/32 |
| 8,740,649 | B2 * | 6/2014 | Lan | H01R 13/506 439/607.4 |
| 8,882,540 | B2 * | 11/2014 | Yen | H01R 13/6581 439/489 |

(Continued)

FOREIGN PATENT DOCUMENTS

| | | |
|---|---|---|
| CN | 203859329 | 10/2014 |

*Primary Examiner* — Phuong Dinh

(74) *Attorney, Agent, or Firm* — Wei Te Chung; Ming Chieh Chang

(57) ABSTRACT

An electrical connector includes: an insulative housing having a base portion and a tongue portion extending forwardly from the base portion, the tongue portion having a plurality of terminal-receiving slots, a respective separating wall being disposed between every two neighboring terminal-receiving slots, at least one separating wall having an extending portion extending backwardly along an insertion direction to be located behind respective rear ends of the other separating walls; a number of terminals retained in the insulative housing and including a row of first contacts, each first contact having a pair of gaps located forwardly of the extending portion along the insertion direction; a metallic shielding plate retained in the insulative housing; and a shielding shell attached to the insulative housing.

7 Claims, 10 Drawing Sheets

(56) References Cited

U.S. PATENT DOCUMENTS

| | | | | |
|---|---|---|---|---|
| 8,926,367 | B2 * | 1/2015 | Hsu | H01R 13/658 439/607.35 |
| 9,231,356 | B1 * | 1/2016 | Ju | H01R 24/78 |
| 2010/0173529 | A1 * | 7/2010 | He | H01R 13/6471 439/660 |
| 2011/0076895 | A1 * | 3/2011 | Zheng | H01R 23/6873 439/660 |
| 2014/0364013 | A1 * | 12/2014 | Yu | H01R 13/193 439/660 |
| 2016/0020568 | A1 | 1/2016 | Ju et al. | |
| 2016/0380388 | A1 | 12/2016 | Guo et al. | |

* cited by examiner

ELECTRICAL CONNECTOR HAVING EXTENDED SEPARATING WALL PORTION FOR PREVENTING INSERTION OF UNCUT TERMINALS

BACKGROUND OF THE INVENTION

1. Field of the Invention

The present invention relates to an electrical connector having an insulative housing designed to prevent insertion of terminals where cutoff bridges have not been removed.

2. Description of Related Art

China Patent No. 203859329 discloses a reversible electrical connector. The electrical connector includes a first module, a second module mounted to the first module, and a shell. The first module has a first insulator, a number of first contacts, and a shielding plate retained in the first insulator. The first insulator has a tongue portion defining a first surface and a second surface. The second surface defines a number of slots. The second module has a second insulator and a number of second contacts retained in the second insulator. The first contacts are exposed from the first surface and the second contacts are received in the slots and exposed from the second surface. During manufacturing of this electrical connector, the second contacts prior to cutting cutoff bridges of a metal carrier might still be assembled mistakenly.

U.S. Patent Application Publication No. 2016/0020568 discloses a reversible electrical connector including a body, plural terminals fixedly disposed in the body, and a metal casing covering the body. The terminals are divided into an upper and a lower row, which are each insert molded with an insulation block to form an upper terminal module and a lower terminal module.

An improved electrical connector is desired.

SUMMARY OF THE INVENTION

One object of the present invention is to provide an electrical connector, comprising: an insulative housing having a base portion and a tongue portion extending forwardly from the base portion, the tongue portion having a plurality of terminal-receiving slots, a respective separating wall being disposed between every two neighboring terminal-receiving slots, at least one separating wall having an extending portion extending backwardly along an insertion direction to be located behind respective rear ends of the other separating walls; a plurality of terminals retained in the insulative housing, the plurality of terminals including a row of first contacts, each first contact having a pair of gaps located forwardly of the extending portion along the insertion direction; a metallic shielding plate retained in the insulative housing; and a shielding shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
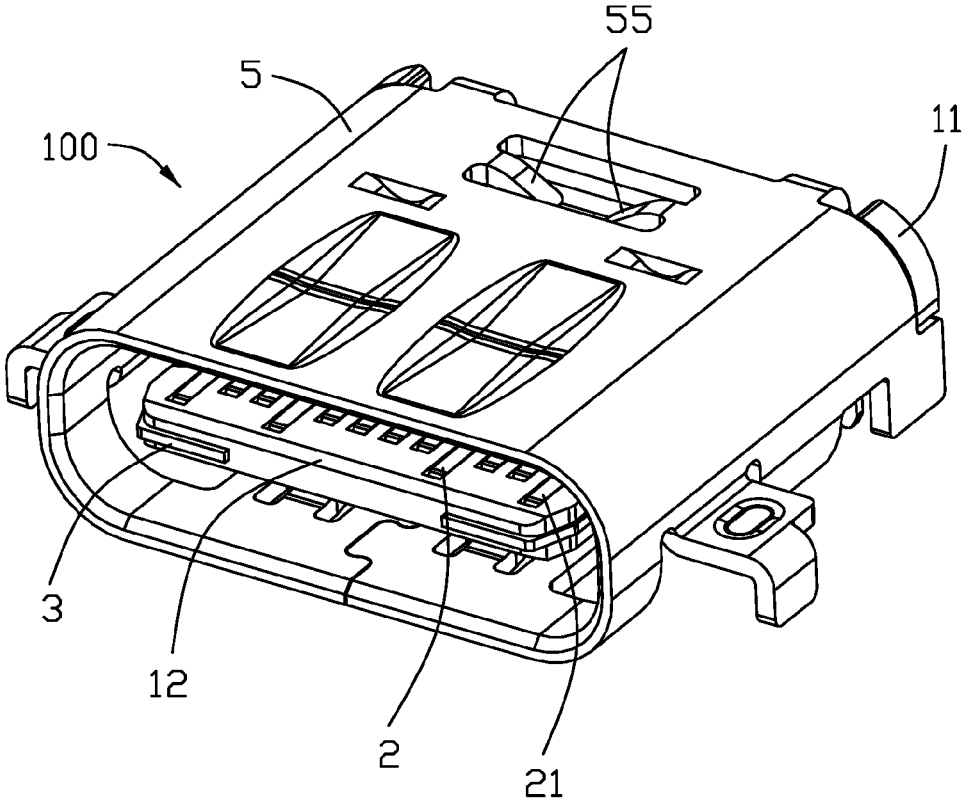
FIG. 1 is a perspective, assembled view of an electrical connector.
Figure 2:
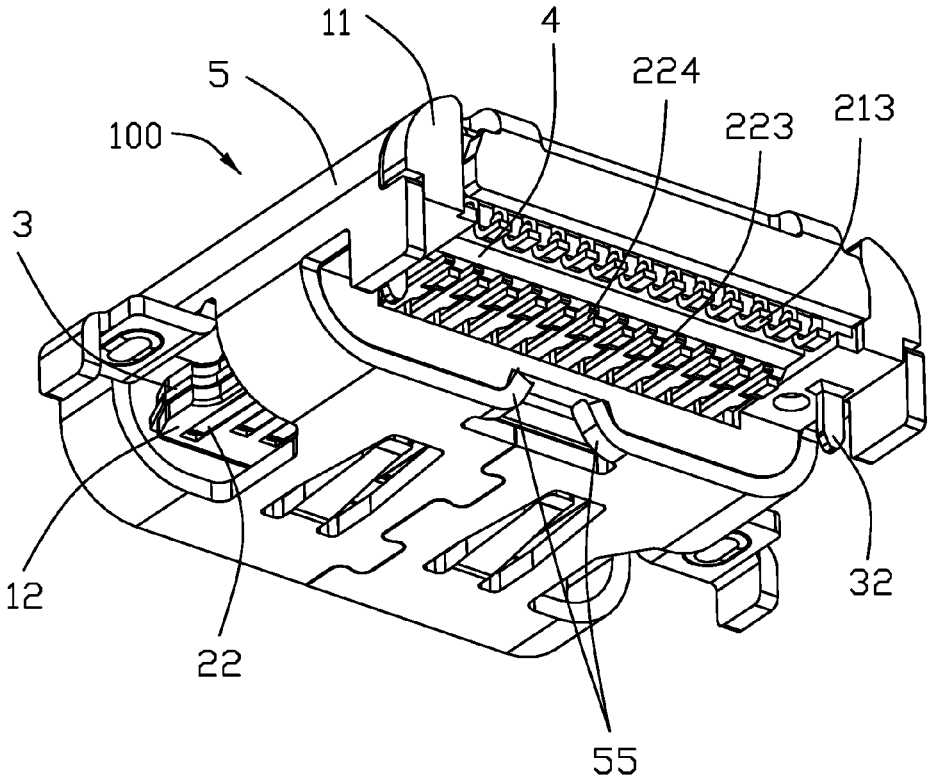
FIG. 2 is another perspective, assembled view of FIG. 1.
Figure 3:
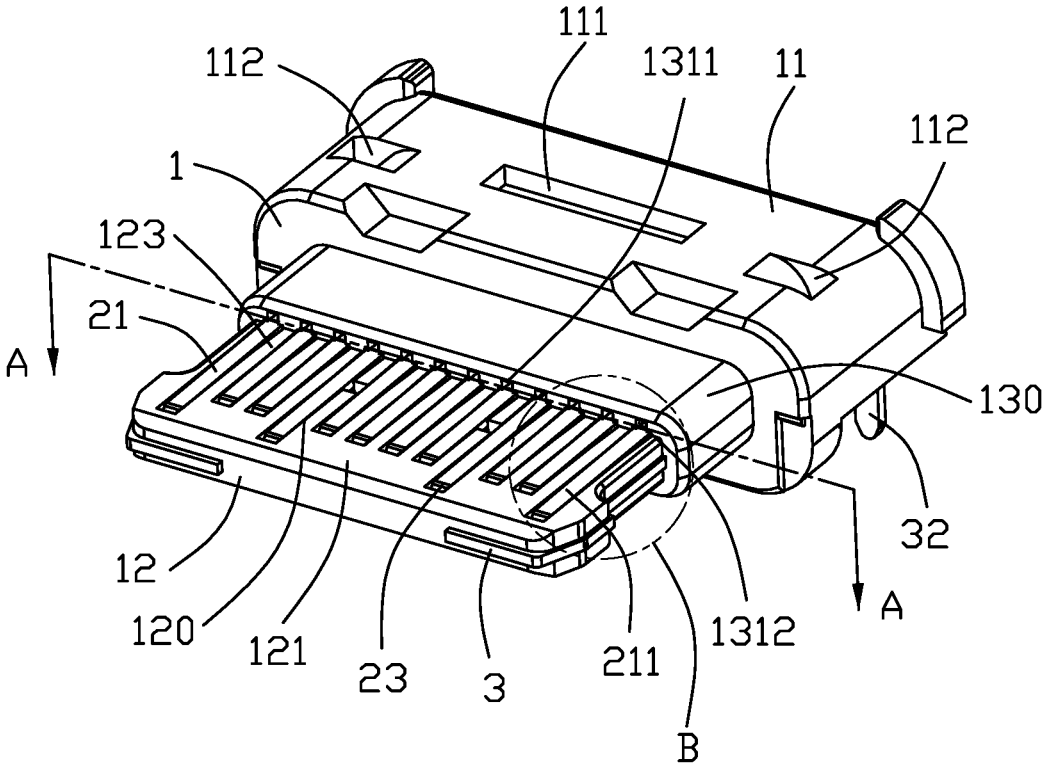
FIG. 3 is a perspective view of the electrical connector separated with a shielding shell.
Figure 4:
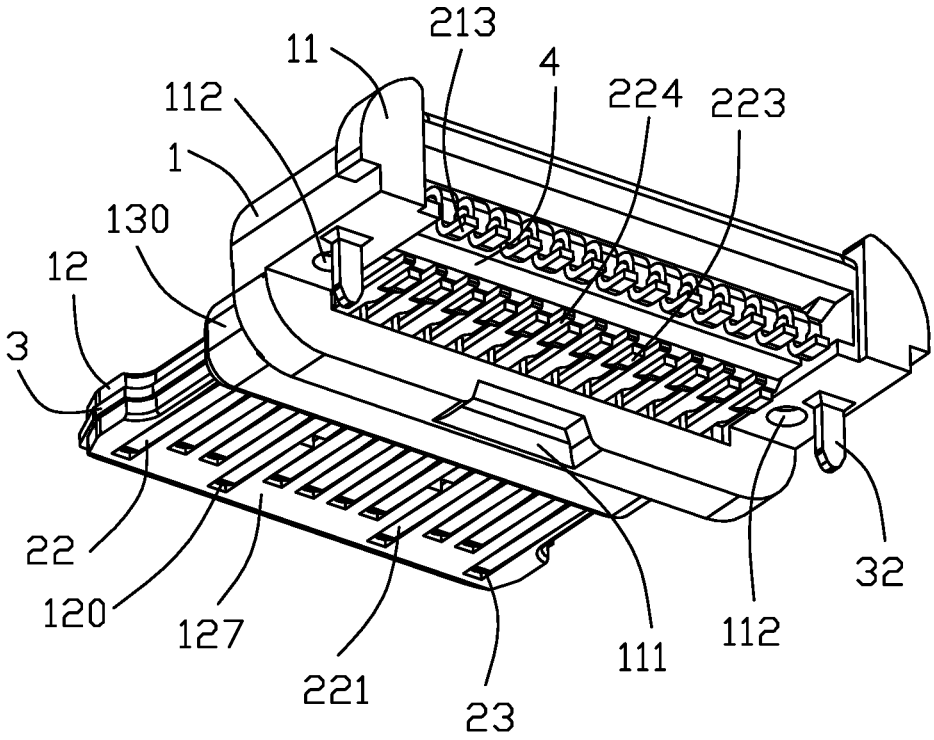
FIG. 4 is another perspective view of FIG. 3.

Reference will now be made in detail to the preferred embodiment of the present invention.

FIGS. 1 to 8 show an electrical connector 100 cooperated with a plug connector. For convenience, the electronic connector 100 defines a mating port, an insertion direction, a transverse direction perpendicular to the insertion direction and forming a horizontal plane therebetween, and a vertical direction perpendicular to the insertion direction and the transverse direction in FIG. 1.

Referring to FIGS. 1-7, the electrical connector 100 includes an insulative housing 1, a number of terminals 2 and a metallic shielding plate 3 retained in the insulative housing 1, an insulator 4 received in the insulative housing 1, and a shielding shell 5 attached to the insulative housing 1.

Figure 8:
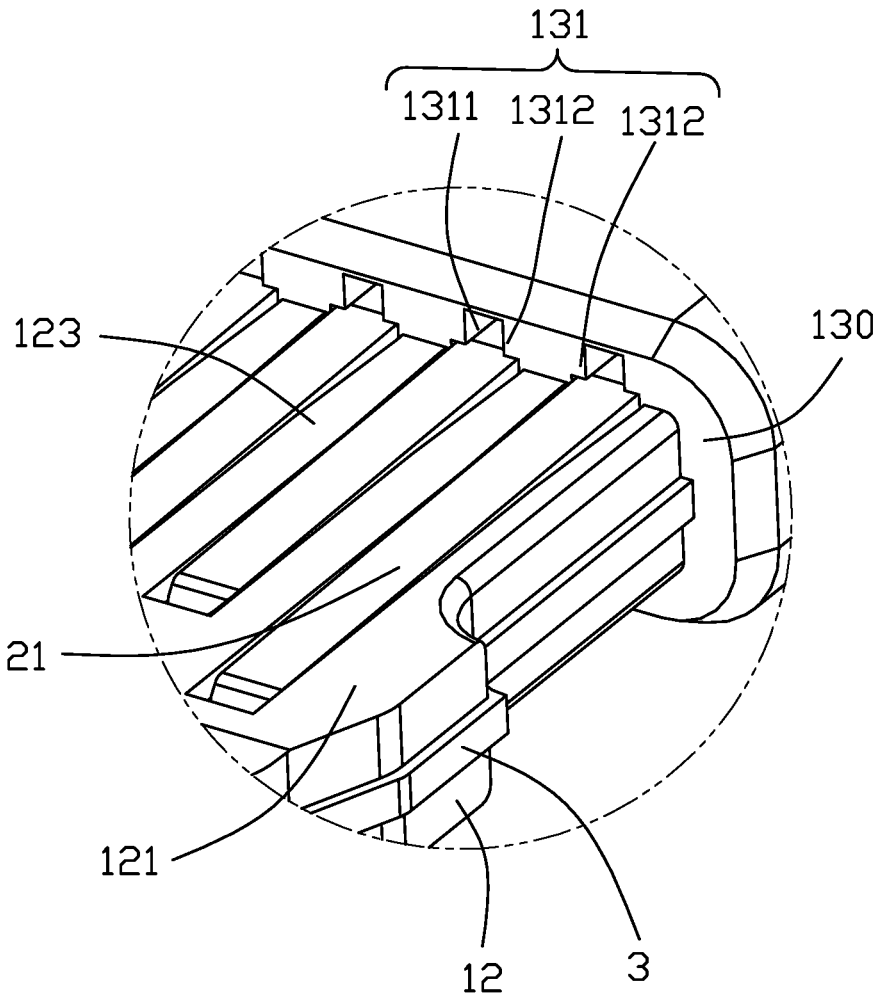
FIG. 8 is an amplified partly view of B in FIG. 3.
Figure 9:
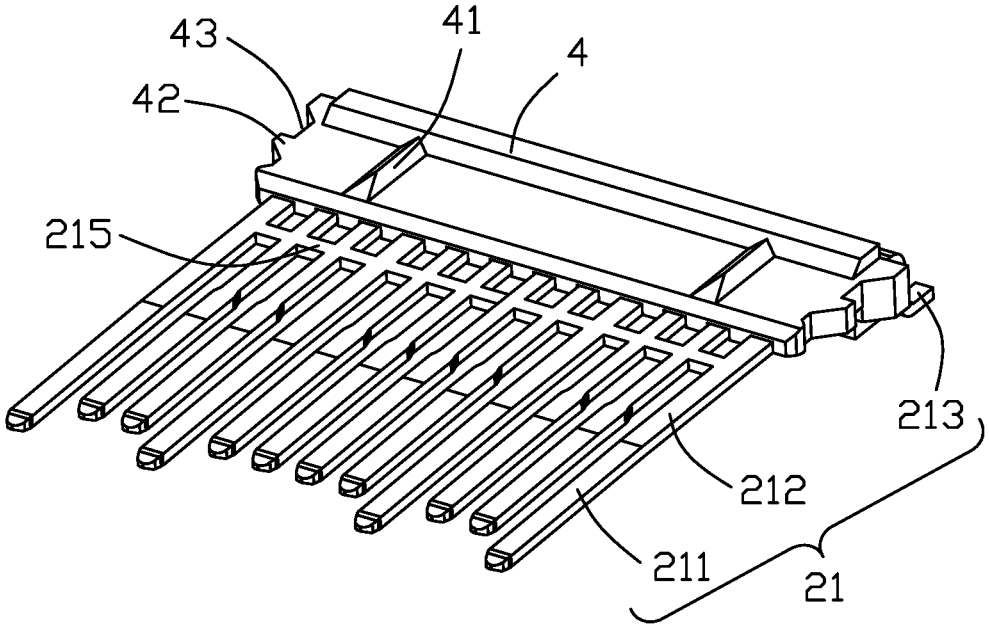
FIG. 9 is a perspective view of an insulator and a number of first contacts connected with metal carriers.
Figure 10:
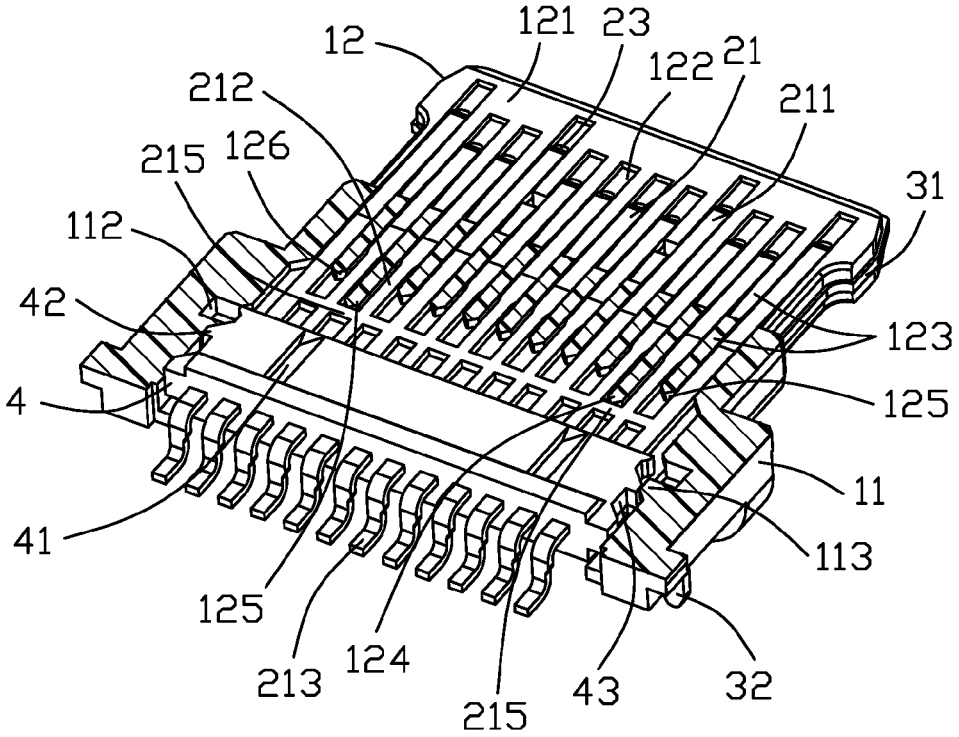
FIG. 10 is a cross-sectional view of an insulative housing, the insulator, and the first contacts connected with metal carriers.

Referring to FIGS. 1 to 8, the insulative housing 1 includes a base portion 11 defining a receiving cavity 110 and a tongue portion 12 extending forwardly from the base portion 11. The base portion 11 has a pair of receiving holes 112 communicated with an upper surface and a lower surface thereof, a pair of projections 113 located behind the receiving holes 112, and a division 114 located at a rear end thereof. The tongue portion 12 defines a first surface 121 and a second surface 122 disposed oppositely, and a number of terminal-receiving slots 120 extending along the insertion direction and located at the first surface 121 and the second surface 122. The neighboring terminal-receiving slots 120 located at the first surface 121 define a separating wall 123. Two of the separating walls 123 located at symmetrical positions respectively define a pair of extending portions 124 extending backwardly therefrom. The extending portions 124 and other separating walls 123 define a number of guiding portions 125 located at a rear end. Each guiding portion 125 defines a pair of inclined surfaces 126 guiding the terminals 2 into the terminal-receiving slots 120 located at the first surface 121 correctly. Referring to FIG. 8, the tongue portion 12 defines a connection 130 connected with the base portion 11. The connection 130 has a number of resisting structures 131. Each resisting structure 131 has an aperture 1311 located above the terminal-receiving slot 120 and communicated with the corresponding terminal-receiving slot 120 and a pair of stepping portions 1312 located between the aperture 1311 and the corresponding terminal-receiving slot 120 and resisted against by the corresponding terminal 2. The pair of stepping portions 1312 are disposed discontinuously and resists two sides of the corresponding terminal 2 along the transverse direction. The division 114 divides rear openings of the terminal-receiving slots 120 located at the first surface 121 and the second surface 122 along the vertical direction.

Figure 5:
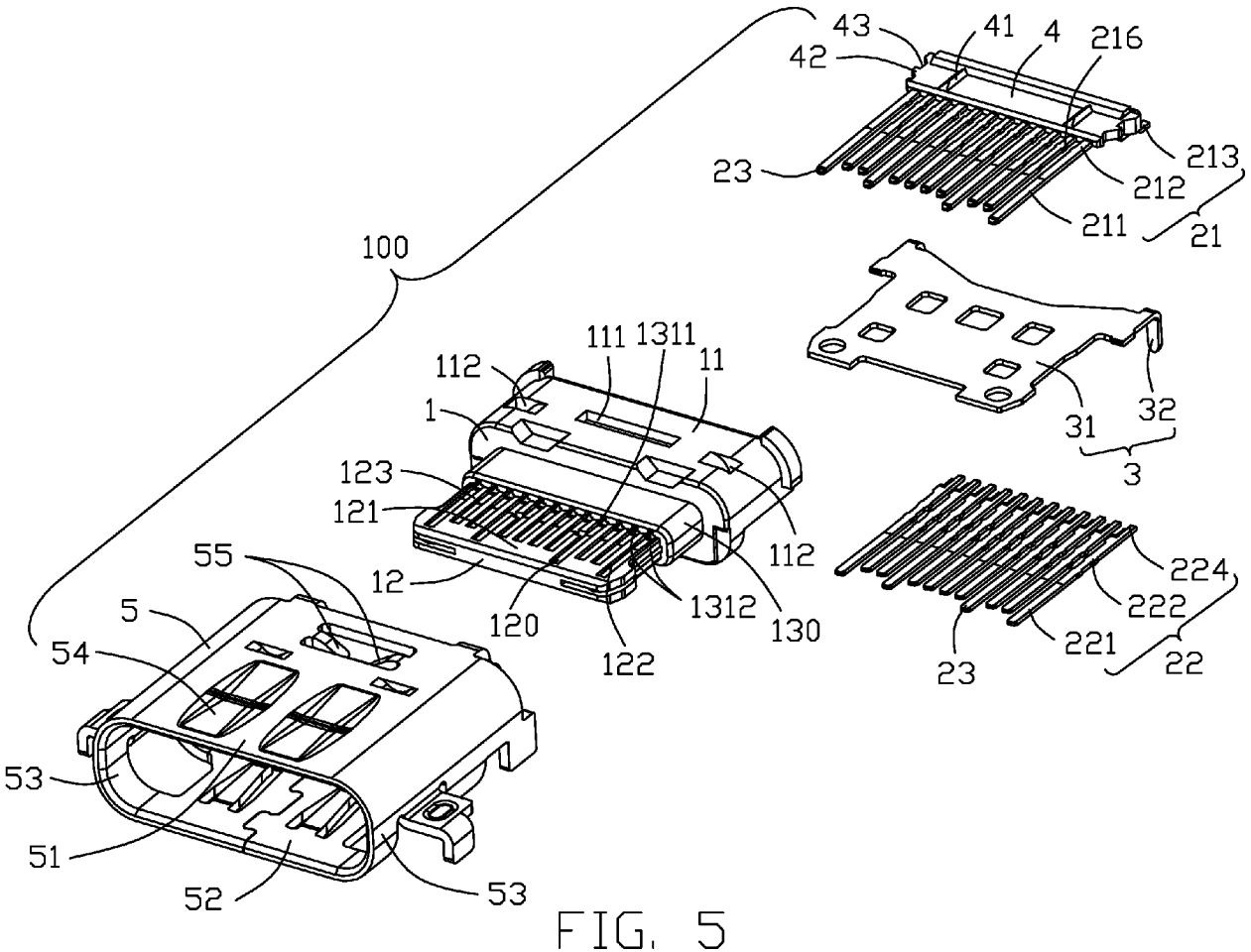
FIG. 5 is a perspective, partly exploded view of the electrical connector.
Figure 6:
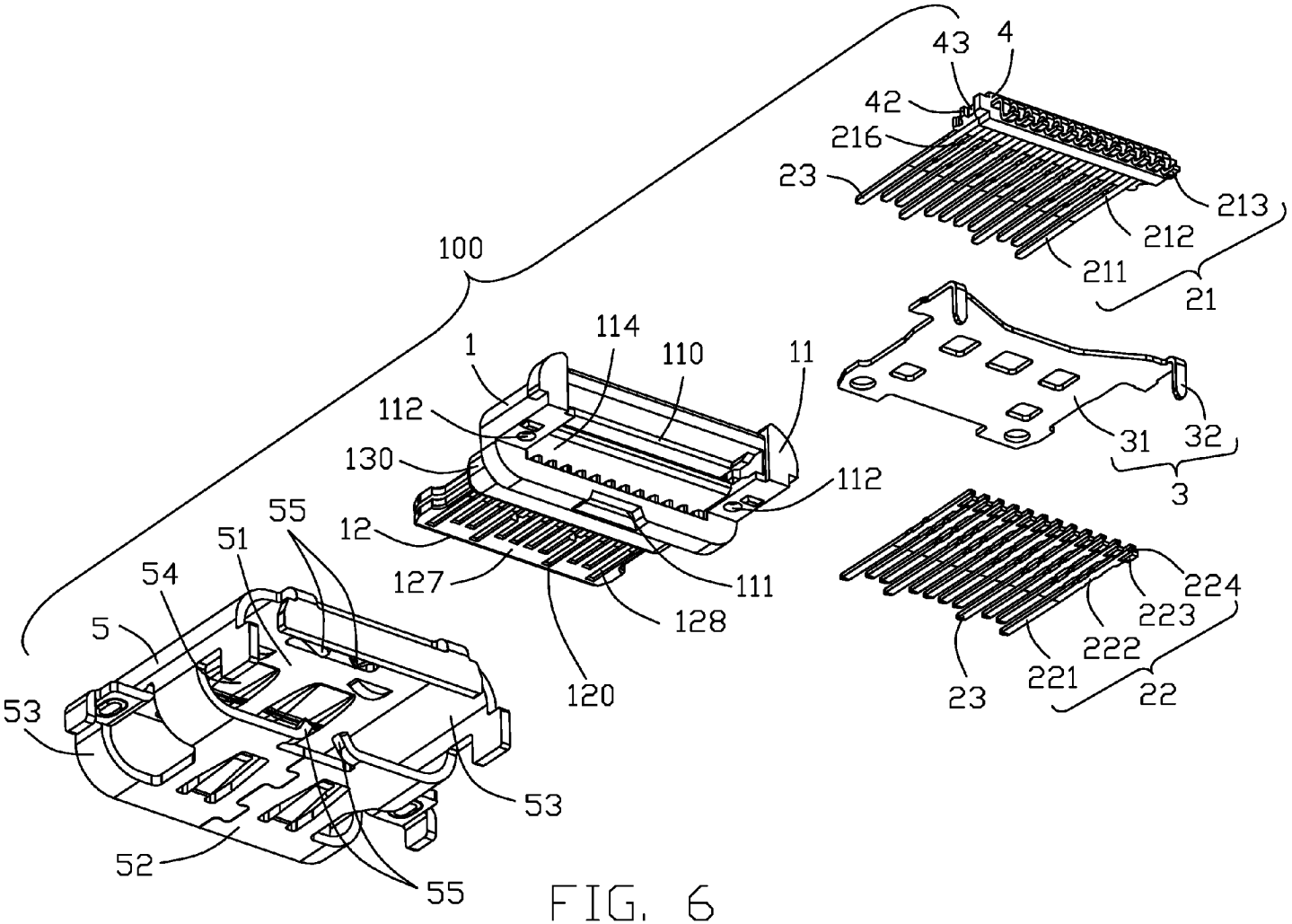
FIG. 6 is another perspective, partly exploded view of FIG. 5.
Figure 7:
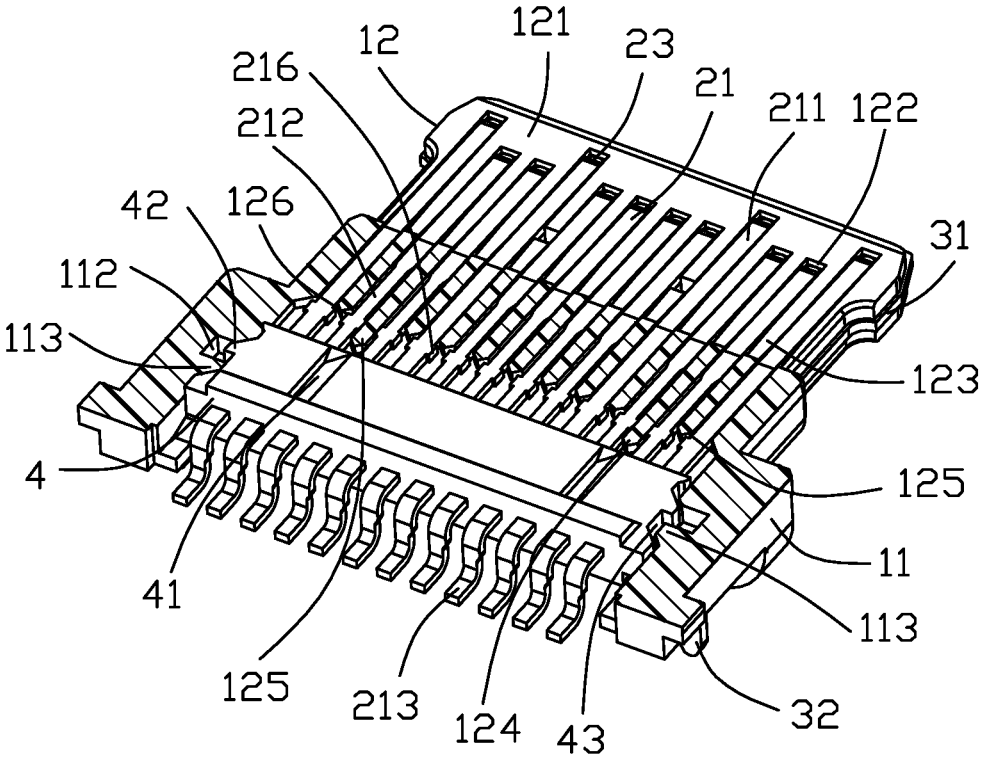
FIG. 7 is a cross-sectional view along line 7-7 of FIG. 3.

Referring to FIGS. 5 and 6, the terminals 2 include a number of first contacts 21 carried by the first surface 121 of the tongue portion 12 and a number of second contacts 22 carried by the second surface 122 of the tongue portion 12. The first contacts 21 and the second contacts 22 extending in an insertion direction respectively includes four power contacts located forwardly and eight signal contacts located backwardly. The two power contacts in the middle are used to provide electric source and the other two are used for electrical grounding. The eight signal contacts includes four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 includes a first contacting portion 211 exposed from the first surface 121, a first affixed portion 212 extending along the insertion direction, and a first soldering portion 213 extending from a back end of the insulator 4. The first contacts 21 are insert-molded with the insulator 4 to form a terminal module wholly and the first affixed portions 212 are retained in the insulator 4. Each of the second contacts 22 shaping like a panel, includes a second contacting portion 221 exposed from the second surface 122 of the tongue portion 12, a second affixed portion 222 retained in the tongue portion 12, and a second soldering portion 223 extending from a back end of the base portion 11. Each of the second contacts 22 has a tail portion 224 extending backwardly from the second affixed portion 222 and separated from the second soldering portion 223. In manufacture, the tail portions 224 are used for pressing and orienting and prevent interfering with the orienting and forming of the second soldering portions 223 in bending the second soldering portions 223. Each of the first contacts 21 and the second contacts 22 respectively has an end portion 23 extending close to the metallic shielding plate 3 so that the terminals 2 are incapable of up-warping to scrape or null contact.

Each of the first contact 21 defines a number of metal carriers 215 connected therewith before cutting off and a number of gaps 216 formed after cutting off the metal carriers 215. Each extending portion 124 of the insulative housing is located between the neighboring gaps 216 of the first contacts 21. The guiding portions 125 of the extending portions 124 are resisted against by the metal carriers 215 to prevent the insulator 4 with the first contacts 21 inserting into the insulative housing 1, when the first contacts 21 still mistakenly connected with the metal carriers are insert-molded with the insulator 4. Two sides of the first affixed portions 212 are resisted against by low surfaces of the two stepping portions 1312 to release pressure form the stepping portions 1312 and prevent the first contacting portion 211 tilting upwardly pressed by downward pressure of the first affixed portions 212.

Referring to FIGS. 5 and 6, the metallic shielding plate 3, sandwiched between the first contacts 22 and the second contacts 22, includes a supporting portion 31 retained in the insulative housing 1 and a pair of affixed legs 32 extending downwardly from a rear end of the supporting portion 31.

Referring to FIGS. 5 and 6, the insulator 4 has a number of ribs 41 resisting an inner surface of the receiving cavity 110 of the insulative housing 1 to affix the insulator 4 stably with the insulative housing 1. The insulator 4 has a number of protrusions 42 located at two sides thereof and a number of depressions 43 adjacent to the projections 42. The projections 42 protrude to the receiving holes 112 of the insulative housing 1 and the projections 113 are received in the depressions 43 to orient the insulator 4 in the insulative housing 1 and prevent the insulator 4 withdrawing. The receiving holes 112 are used to observe the assembly of the insulator 4 and the insulative housing 1. The shielding shell 5 includes opposite top wall 51 and bottom wall 52, and a pair of side walls 53 linked therebetween by two sides. Each of the top wall 51 and the bottom wall 52 has an inward retention arm 55. The top wall 51 has a plurality of dimples 54 for engagement with the shell of the complementary connector.

A method of making the electrical connector 100 includes the steps of: providing a metallic shielding plate 3, insert-molding the insulative housing 1 with the metallic shielding plate 3, the neighboring terminal-receiving slots 120 define a separating wall 123 located therebetween, a pair of the separating walls 123 having the extending portion 124 extending backwardly from a rear end thereof and located behind the other separating walls 123 along the insertion direction; providing a number of second contacts 22, assembling the second contacts 22 to the terminal-receiving slots 120 located at the second surface 122; providing a number of first contacts 21 connected with the metal carriers 215, insert-molding the insulator 4 with the first contacts 21 connected with the metal carriers 215; cutting off the metal carriers 215 between the neighboring first contacts 21 to form a pair of gaps 216 located at two sides of the first contacts 21; assembling the insulator 4 with the first contacts 21 to the insulative housing 1 to dispose the first contacts 21 in the terminal-receiving slots 120 of the first surface 121, the pair of the extending portions 124 located at the neighboring gaps 216, two sides of the first affixed portion 212 resisted against by low surfaces of the two stepping portions 1312; enclosing the shielding shell 4 in the insulative housing 1.

However, the disclosure is illustrative only, changes may be made in detail, especially in matter of shape, size, and arrangement of sections within the principles of the invention.

What is claimed is:

1. An electrical connector comprising:

an insulative housing having a base portion and a tongue portion extending forwardly from the base portion, the tongue portion having a plurality of terminal-receiving slots, a respective separating wall being disposed between every two neighboring terminal-receiving slots, at least one separating wall having an extending portion extending backwardly along an insertion direction to be located behind respective rear ends of the other separating walls;

a plurality of terminals retained in the insulative housing, the plurality of terminals including a row of first contacts, each first contact having a pair of gaps located forwardly of the extending portion along the insertion direction;

a metallic shielding plate retained in the insulative housing; and a shielding shell attached to the insulative housing, wherein the terminal-receiving slots define a plurality of guiding portions located at the separating walls, each guiding portion having a pair of inclined surfaces at two sides thereof, wherein said tongue portion defines opposite first and second surfaces, and the row of first contacts is insert molded with an insulator located in the terminal-receiving slots in the first surface, wherein said plurality of terminals include a row of second contacts assembled into the terminal-receiving slots and exposed from the second surface, wherein said base portion has a pair of receiving holes communicated with an upper surface and a lower surface thereof and a pair of projections located beside the receiving holes, and the insulator has a plurality of ribs resisted against by an inner surface of the insulative housing, a pair of protrusions located at two sides thereof and received in the receiving holes, and a pair of depressions located beside the protrusions and receiving the projections, wherein each first contact has a first contacting portion, each second contact has a second contacting portion, each of the first contacting portions and the second contacting portions being tapered.

2. An electrical connector comprising:

an insulative housing having a base portion and a tongue portion extending forwardly from the base portion, the tongue portion having a plurality of terminal-receiving slots, the tongue portion defining a connection connected with the base portion, the connection having a plurality of resisting structures, each resisting structure having an aperture located above the terminal-receiving slot and communicated with a corresponding terminal-receiving slot and a pair of stepping portions located between the aperture and the corresponding terminal-receiving slot;

a plurality of terminals retained in the insulative housing, each terminal bearing against a corresponding pair of stepping portions;

a metallic shielding plate retained in the insulative housing; and a shielding shell attached to the insulative housing, wherein the terminal-receiving slots define a plurality of guiding portions located at the separating walls, each guiding portion having a pair of inclined surfaces at two sides thereof, wherein said tongue portion defines opposite first and second surfaces, and the row of first contacts is insert molded with an insulator located in the terminal-receiving slots in the first surface, wherein said plurality of terminals include a row of second contacts assembled into the terminal-receiving slots and exposed from the second surface, wherein said base portion has a pair of receiving holes communicated with an upper surface and a lower surface thereof and a pair of projections located beside the receiving holes, and the insulator has a plurality of ribs resisted against by an inner surface of the insulative housing, a pair of protrusions located at two sides thereof and received in the receiving holes, and a pair of depressions located beside the protrusions and receiving the projections, wherein each first contact has a first contacting portion, each second contact has a second contacting portion, each of the first contacting portions and the second contacting portions being tapered.

3. The electrical connector as claimed in claim 2, wherein the pair of stepping portion are disposed discontinuously and resist against two sides of the corresponding terminal along a transverse direction.

4. An electrical connector comprising:

an insulative housing having a base portion and a tongue portion forwardly extending from the base portion along a front-to-back direction, the tongue portion having a plurality of terminal receiving slots with a plurality of separating walls alternately arranged with said plurality of terminals in a transverse direction perpendicular to said front-to-back direction;

at least one of said separating walls including an extending portion extending rearwardly in a front-to-back direction with a distance beyond other separating walls;

a plurality of terminals respectively forwardly inserted into and retained in the terminal receiving slots with a plurality of gaps each formed between every two neighboring terminals in said transverse direction; and an insulator integrally formed with said plurality of terminals via an insert-molding process to form a terminal module; wherein said terminals are originally equipped with carriers in the corresponding gaps for said insert-molding process while being removed before said terminal module is assembled into the housing with the terminals retained in the terminal receiving slots, respectively; wherein said at least one extending portion abuts against the corresponding carrier to prevent a plurality of terminals including a row of first contacts from being mistakenly inserted into the corresponding terminal receiving slots when the carriers have not been removed therefrom, wherein the terminal-receiving slots define a plurality of guiding portions located at the separating walls, each guiding portion having a pair of inclined surfaces at two sides thereof, wherein said tongue portion defines opposite first and second surfaces, and the row of first contacts is insert molded with an insulator located in the terminal-receiving slots in the first surface, wherein said plurality of terminals include a row of second contacts assembled into the terminal-receiving slots and exposed from the second surface, wherein said base portion has a pair of receiving holes communicated with an upper surface and a lower surface thereof and a pair of projections located beside the receiving holes, and the insulator has a plurality of ribs resisted against by an inner surface of the insulative housing, a pair of protrusions located at two sides thereof and received in the receiving holes, and a pair of depressions located beside the protrusions and receiving the projections, wherein each first contact has a first contacting portion, each second contact has a second contacting portion, each of the first contacting portions and the second contacting portions being tapered.

5. The electrical connector as claimed in claim 4, further including a metallic shell enclosing said housing.

6. The electrical connector as claimed in claim 5, further including a metallic shielding plate embedded within the housing via another insert-molding process.

7. The electrical connector as claimed in claim 6, wherein said terminals are arranged in two rows on two opposite surfaces of the tongue portion, and one row of said terminals are part of said terminal module while the other row of terminals are respectively assembled to the housing.

* * * * *